US006406220B1

(12) United States Patent
Thomson

(10) Patent No.: US 6,406,220 B1
(45) Date of Patent: Jun. 18, 2002

(54) ARCHED SUPPORT STRUCTURE

(76) Inventor: James Crawford Thomson, International Centre Cointrin, CP 1829, CH-1215 Geneva 15 (CH)

( * ) Notice: Subject to any disclaimer, the term of this patent is extended or adjusted under 35 U.S.C. 154(b) by 0 days.

(21) Appl. No.: 09/529,086

(22) PCT Filed: Oct. 7, 1998

(86) PCT No.: PCT/GB98/03007

§ 371 (c)(1),
(2), (4) Date: May 1, 2000

(87) PCT Pub. No.: WO99/19603

PCT Pub. Date: Apr. 22, 1999

(30) Foreign Application Priority Data

Oct. 9, 1997 (GB) ..... 9721400

(51) Int. Cl.[7] ..... E04B 1/32; E04C 3/44; E02D 29/00; E21D 11/00

(52) U.S. Cl. ..... 405/132; 405/134; 405/146; 52/89; 52/724.4

(58) Field of Search ..... 405/132, 134, 405/138, 141, 146; 52/86–89, 724.4

(56) References Cited

U.S. PATENT DOCUMENTS

| | | | | |
|---|---|---|---|---|
| 3,916,630 A | | 11/1975 | Arsuaga | 405/139 |
| 4,187,037 A | * | 2/1980 | Seiz et al. | 405/150.1 |
| 4,558,969 A | * | 12/1985 | FitzSimons | 405/124 |
| 4,907,910 A | * | 3/1990 | Teron | 405/132 |
| 4,929,123 A | * | 5/1990 | Lunardi | 405/138 |
| 4,940,360 A | * | 7/1990 | Weholt | 405/151 |
| 5,351,353 A | * | 10/1994 | Walters | 405/132 X |

FOREIGN PATENT DOCUMENTS

| | | | |
|---|---|---|---|
| DE | 2543997 | 4/1977 | E01G/4/00 |
| DE | 19511675 | 4/1986 | E01D/21/00 |
| DE | 3609791 | 10/1987 | E21D/9/06 |
| EP | 0332799 | 9/1989 | E21D/13/02 |
| FR | 787800 | 12/1972 | |

* cited by examiner

*Primary Examiner*—Thomas B. Will
*Assistant Examiner*—Tara L. Mayo
(74) *Attorney, Agent, or Firm*—Head, Johnson and Kachigian

(57) ABSTRACT

A support structure and method for forming same for use in excavations such as underpasses, tunnels and the like for roads, rail or rivers. The support structure allows the utilization of the strength provided by using arch shaped sections and also minimizes the disruption caused to the soil surrounding the excavation thereby allowing existing road, rail or river services to continue to be used during excavation.

25 Claims, 6 Drawing Sheets

ARCHED SUPPORT STRUCTURE

CROSS-REFERENCE TO RELATED APPLICATIONS

This application claims priority to PCT Application No. GB98/03007 filed Oct. 7, 1998 which claims priority to GB Application No. 9721400.1 filed Oct. 9, 1997.

BACKGROUND OF THE INVENTION

This application relates to the construction of underground structures in tunnel excavations without causing surface disruption. This type of excavation technique has been developed in the last 30 years and there is a growing need to install structures such as, for example, traffic underpasses, below an existing rail track or highway without stopping the use and operation of the same. Another example is the creation of a metro station below a busy street or property.

The problem with traditional tunnelling techniques is that for safety reasons there is required to be a depth of soil of approximately 2 to 3 times the diameter of the tunnel which is to be excavated, above the said tunnel. This renders the traditional techniques impractical and so a number of conventional methods have been developed and are now used which reduce the requirement for such a great depth of soil to be provided above the tunnel. These methods are based on the principle of jacking pre-cast structure units into the excavated area, as the same is excavated to form a structure as the tunnel is formed. The formation of the structure allows the support of the tunnel as it is formed without the need to cause disruption to services or property on the surface.

A known approach is to prepare the structure to be installed at the side of the excavation and then jack it horizontally into position in the excavation. This has the disadvantage of requiring large constructions to be formed at the side and an extended area to be prepared for carrying out the work, usually of at least the same dimensions as the installation. It is also a process that is time consuming as a great deal of preparatory work has to be done in forming the working areas and casting the structure units.

A second known approach is a modular approach where a series of pre-cast units are jacked, one on top of another, to form piers and abutments. This is a system which has found extensive use but has the disadvantage of not providing a complete solution to the problem as, although the majority of the excavation work can be completed without disruption it is necessary at some stage to complete the work by taking possession of the excavation so as to allow installation of the spanning beams.

A third known approach is to create a structure of arch shaped cross section which is formed by a series of relatively small section tubes which run along the length of the structure. This provides a canopy which allows excavation to take place safely underneath. The disadvantages with this is that it is difficult and expensive to place all the tubes in position and, normally it is necessary to provide props for the arch across the base of the same and put in temporary support beams to support the tube arch and these procedures are required to be undertaken as work progresses.

SUMMARY OF THE INVENTION

Documents DE3609791 and U.S. Pat. No. 3,916,630 both disclose methods of formation of support structures with DE3609791 disclaiming the formation of a pipe structure and U.S. Pat. No. 3,916,630 the formation of a structure cast in situ; however neither discloses the formation of an arch structure from units pushed or jacked into the excavation.

The aim of the present invention is to provide an improved process of supporting material excavations by utilising a modular pre-cast unit based on the principle of using units formed of an arch shape such that a series of said units allow an arch structure to be formed, said arch being an efficient form of carrying live and dead loads and therefore well suited to creating an underground structure. The approach is to pre-cast arch panels, erect them in the excavated area and jack the assembled elements forward to form the structure.

In a first aspect of the invention there is provided a support structure which can be used to support excavated areas during and/or following excavation, said support structure including a series of upstanding arch shaped sections, positioned along the length of the excavated area, one after the other, and characterised in that said arch sections are pushed or jacked in an upstanding position into the excavated area.

In a preferred embodiment the support structure is formed with arch section ends being located in and along a series of supporting units. In one preferred embodiment the units have recessed sections, which, when the units are laid end to end, form a track along which the arch sections can slide when jacked. Typically, two linear tracks are formed, said tracks spaced apart by a distance determined by the space between the ends of said arch sections.

Typically, the arch sections and/or supporting units are pre-cast. Yet further, each of the arch sections are formed from a series of panels, constructed on site and prior to insertion into the tunnel.

In a further aspect of the invention, there is provided a method for forming a support structure for an excavated area during and/or after excavation of the same, said method comprising, as the tunnel is excavated, pushing or jacking a series of sections in an upstanding position one after another into said excavated area, characterised in that the sections are arch sections in order to form an arch shaped support structure.

Typically the excavated area is a tunnel and the method comprises the steps of jacking a series of arch sections at intervals to increase the length of the support structure into the tunnel as the tunnel is excavated. The activity of the tunnel excavation takes place to the front of the first of the arch sections introduced.

In one embodiment, supporting units are first positioned in the excavation to act as bases and guides along which the arch structures are introduced.

In one embodiment, the supporting units extend upwardly to form the side walls of the arch shaped structure and it is the curved arch sections which are introduced to form the arch shaped structure. Alternatively the arch sections include both the roof and side walls when jacked into the excavation.

The method of the invention has a number of technical and economic advantages. Arch sections can be formed from a number of panels by factory fabrication, delivered to site and connected together to form the arch.

In one embodiment a temporary shield can be fitted at the leading face, i.e. in front of the first arch section, which allows excavation work to be undertaken safely. This shield is recovered at the end of the excavation and can be re-used for excavations thereafter.

Similarly, a shield can be provided at the front of each supporting unit to allow excavation to proceed safely.

The use of arch panels reduces the temporary working areas required at the excavation site and requires less heavy handling equipment, than with conventional techniques.

Typically, the ends of the panel sections are located in tracks formed by a series of supporting units which are jacked into the tunnel and the method further includes the step of jacking said supporting units into the tunnel to provide tracks of a sufficient length to receive the arch sections to form the support structure and therefore may be advanced to a further position into the excavation than the arch sections. Typically, the units are required to be manipulated after jacking to expose recessed portions to allow the formation of the tracks.

To further improve the structure, hydrophilic gaskets or groutable injection hoses can be introduced, between panels as they are installed in the working pit which serve to waterproof the joints and it should be appreciated that there are many possible variations of details in the design of the foundations and the arch configuration and span.

In one embodiment double, side by side arched structures can be created, for example, for a tunnel for the two carriageways of a divided highway. In one embodiment three or four sets of in line supporting units are provided, said supporting units comprising two lines of outer supporting units and a centre line of double units and/or single units having two guide tracks formed therein, thus allowing the introduction of two sets of side by side sections along said supporting units.

As an alternative embodiment to the use of supporting units in block form there is provided the method of forming tunnels, typically of circular cross section, along the line of the support structure to be formed and said tunnels spaced apart by the spacing required for the arch sections. The tunnels are driven by jacking or by segment construction. In each tunnel there is formed a track for the reception of the ends of the arch sections which again pass along the length of the tracks as with the supporting units and therefore act in a similar manner to support the arch sections.

BRIEF DESCRIPTION OF THE DRAWINGS

Specific embodiments of the invention will now be described with reference to the accompanying drawings, wherein.

DETAILED DESCRIPTION OF THE PREFERRED EMBODIMENT

Figure 1:
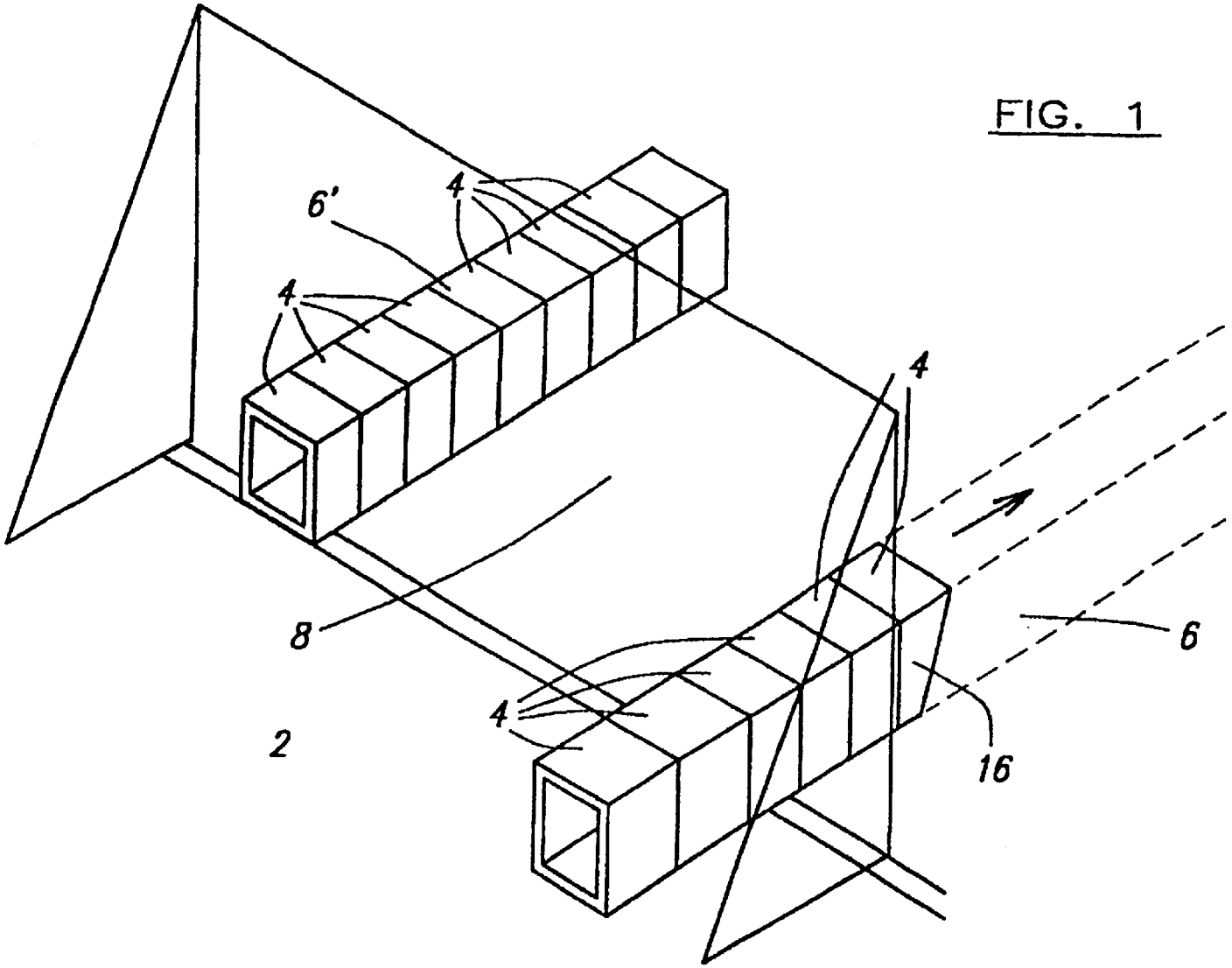
FIG. 1 illustrates a perspective view of the working area and the installation of the supporting units prior to main tunnel excavation.
Figure 2B:
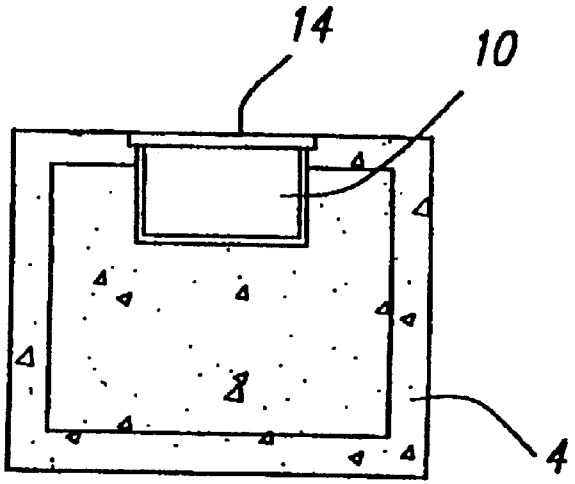
FIGS. 2A–2C illustrate cross sections of the supporting unit before and after jacking into the excavation.
Figure 2A:
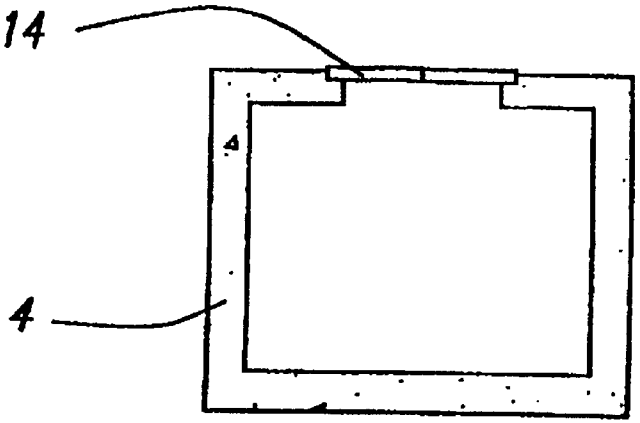
Figure 2C:
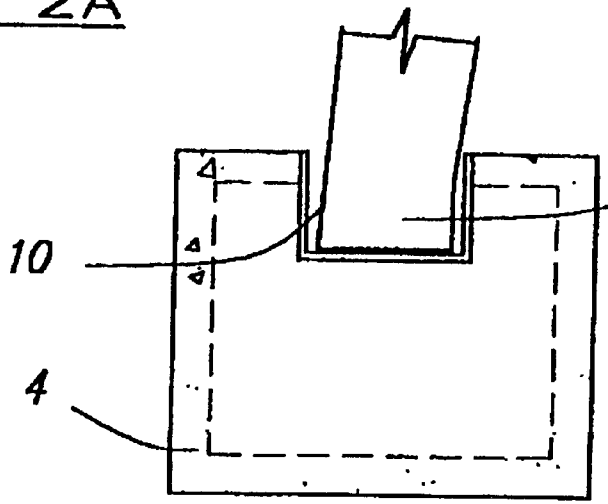

After preparing the working area 2 adjacent to where the structure is to be installed, a series of supporting or foundation units 4 are driven into the excavation material to form the base 6, 6' and base reaction (horizontal and vertical load components) for the arch sections. These supporting units are designed to be of the correct dimensions for the loads and are installed by driving them into the tunnel excavation by pipe jacking methods. For convenience and economy the units can be pre-cast off site in suitable handlable lengths and then brought to site as required. The units are designed so that after being installed they can be modified by undertaking work from inside the units by workers to provide a finished foundation structure for the structure and form tracks 10, 10', at the correct level as shown in FIGS. 2A–2C whereby the supporting units 4 are shown in FIG. 2A in the form in which they are jacked. FIG. 2B shows the supporting units after manipulation when positioned in the excavation and FIG. 2C shows the track 10 with an end of an arch section 12 located therein. The units 4 have removable covers 14 which are removed progressively during the excavation of the soil from within the shield 16 to expose the guide tracks 10,10'. The units form a track guide and seating during installation of the arch sections and the permanent foundation, thereafter.

With the supporting units installed to a sufficient length the guide channels on the same are levelled so that the tracks formed on the same are level and the units are then pumped with concrete to form a solid foundation. The next stage in the method is to erect the temporary cutting shield 20 of FIG. 3A which is fabricated in steel with the same outside dimensions, plus a small overcut, as the outside dimension of the arch sections. Some overcut in the excavation allows a reduction in soil friction and allows the introduction of measures to improve jacking of the sections such as lubrication or drag sheets The shield, depending on the geotechnical conditions, can be fitted with shelves, compartments, doors, advance spiles and other devices used in tunnelling excavation as required. These devices assist in controlling the face stability and allow excavation machinery to be operated and excavation to proceed at the various levels of the tunnel.

Figure 3A:
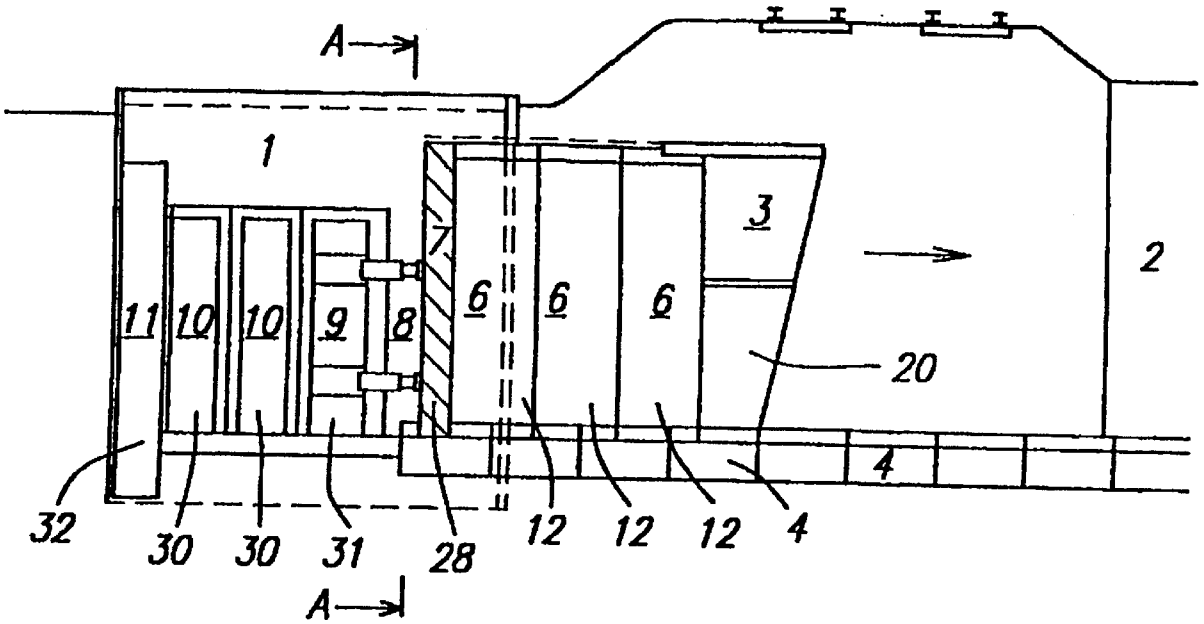
FIG. 3A illustrates a side elevation of an excavation with a support structure according to the invention.
Figure 3B:
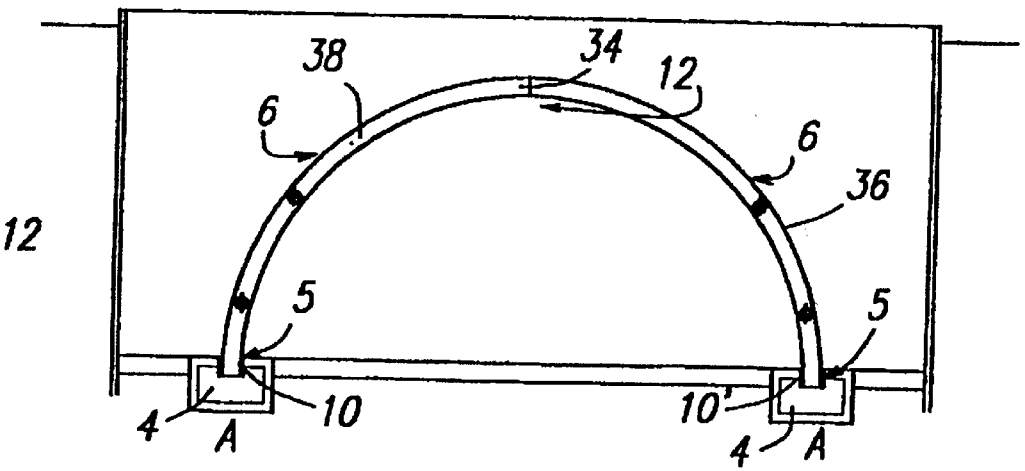
FIG. 3B illustrates a sectional elevation of the apparatus of FIG. 3B showing the structure of one of the arch sections.

In practise, the shield is introduced into the soil through the head wall and along the tracks 10, 10' of the supporting units and excavation at the face commences, typically by face miners with the aid of mechanical equipment. As the shield advances, arch sections 12, art jacked into the excavation behind the shield and along the tracks 10, 10' as shown in FIGS. 3A and 3B. A steel jacking ring 28 can be used to distribute the jacking loads uniformly onto the arch sections and in one embodiment shown in FIG. 3A spacers 30 are used to allow the jacking reaction from the jacking rig 31 to be transferred onto the reaction wall 32. Alternatively, it is possible to have telescopic jacks mounted on the reaction wall with a stroke equivalent to the width of the section which would eliminate the need for the spacers to be used. Individual arch sections can be of any suitable dimension, but typically 2 to 3 meters in length. The ends of the sections 12 are located at the end foots in the tracks 10, 10' of the supporting units 4 so they cannot spread apart during the jacking operation or thereafter. Typically, the staggering of the joints of the supporting units 4 is possible to allow use of the previously placed arch section to provide support for the next one.

It is preferred to have the supporting units extending outwith the excavated area into the working or reception area so as to allow the shield 20 and arch sections 12 to be provided in the correct configuration prior to jacking and, as they are then held in the tracks 10, 10' they can not deviate from line or level.

It is possible to jack both two pinned arch sections and three pinned arch sections into the excavation. The latter being preferable in that the two panels 36, 38 of a three pinned arch as shown in FIG. 3B are envisaged to be more easily handleable than the single unit of a two pinned arch. Furthermore a three pinned arch is more structurally efficient and can be provided with a suitably designed crown connection 34.

The arch sections are introduced and hence pushed forward as excavation advances by jacks mounted in a suitable frame and having a reaction against a suitable structure. Such arrangements are well known and widely used. When the end of the excavation is reached and the reception shaft of the excavation is reached, the shield is removed.

Figure 3C:
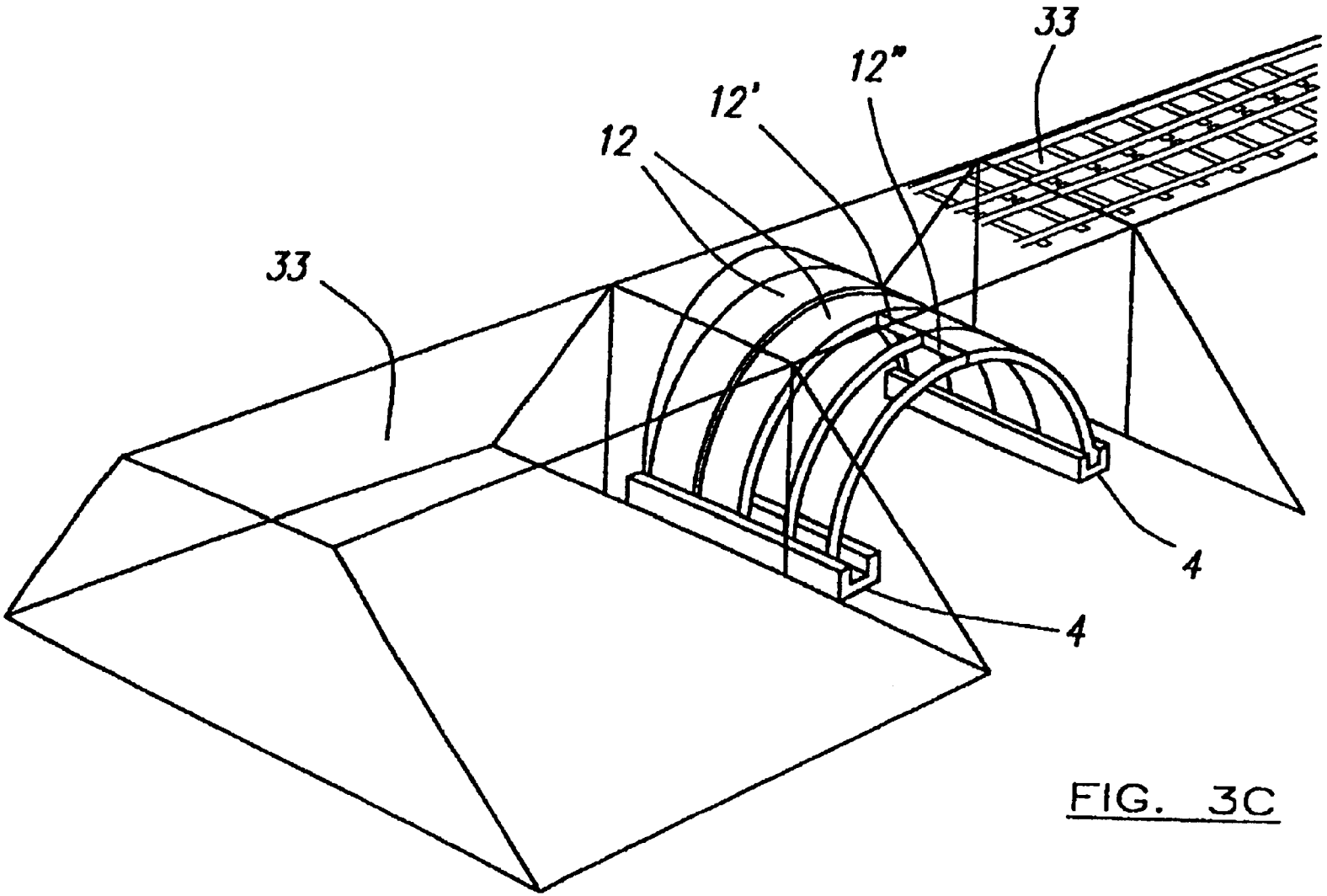
FIG. 3C illustrates a perspective view of a partially completed structure of the type shown in FIGS. 3A and 3B.

FIG. 3C illustrates a partially formed support structure 31 formed of a series of arch structures 12 and supporting units 4 with part of the arch sections 12', 12" removed in the drawing for ease of reference only. In this case the support structure is being formed under a railway line embankment 33 as shown.

Figure 4:
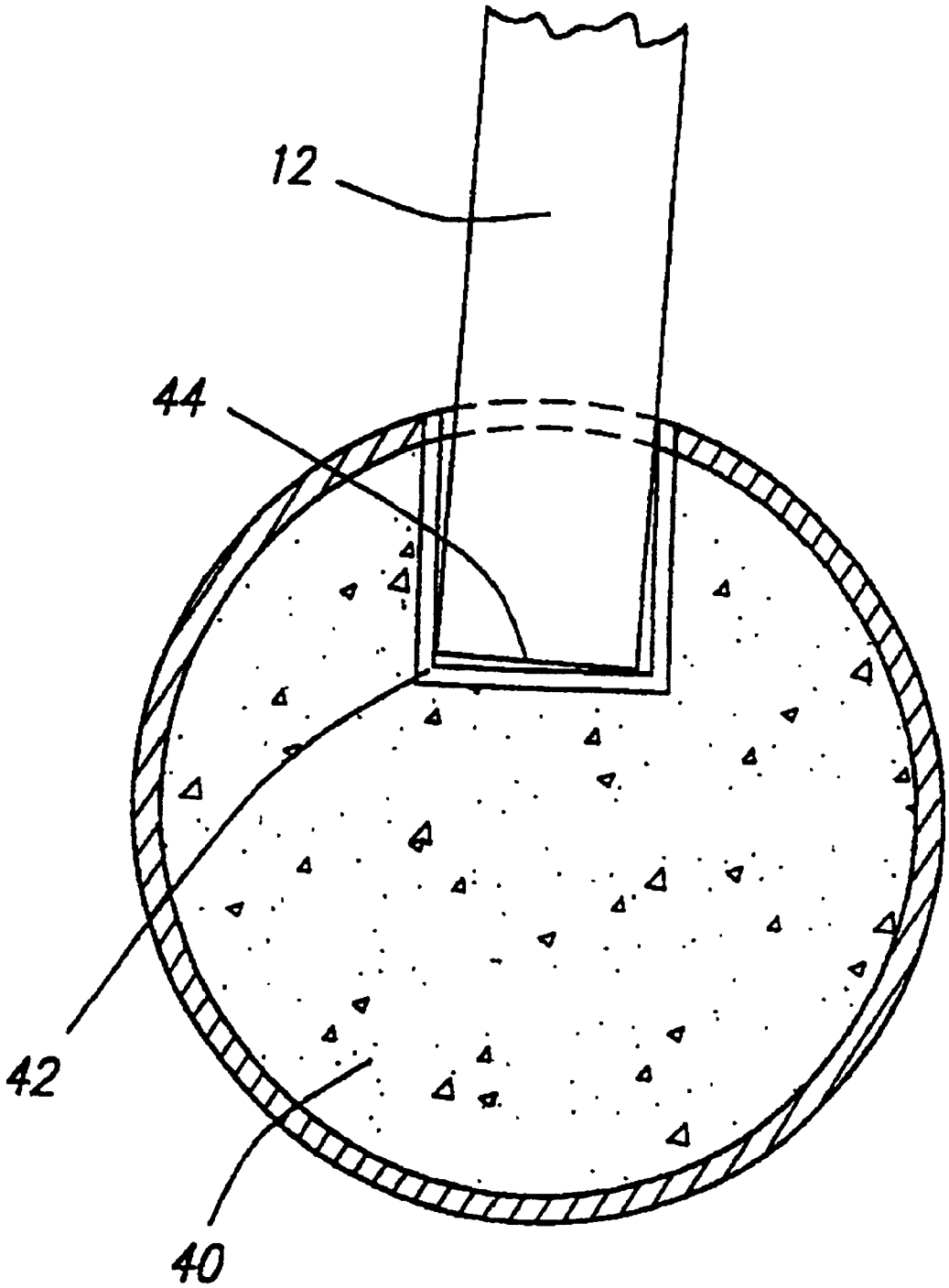
FIG. 4 illustrates the use of the embodiment of using tunnel supports for the arch sections.

As an alternative embodiment to the use of supporting units in block form, there is provided the method of forming tunnels as shown in FIG. 4 which illustrates a cross section of one tunnel, said tunnel 40 typically of circular cross section, and provided along the line of the support structure to be formed. Typically two or three tunnels, as required, are formed, said tunnels spaced apart by the spacing required for the location of the ends 36, 38 of the arch sections. The tunnels are driven by jacking or by segment construction. In each tunnel there is formed a track 42 which can be exposed for the reception of the end 44 of the arch sections 12 which again pass along the length of the tracks as with the supporting units and therefore are introduced and act in a similar manner. The tunnels are typically filled with concrete so as to act as foundations for the structure when formed. The advantage of this embodiment is particularly for use in unstable soil conditions, perhaps below the water table level. The circular tunnels can use conventional pressure balance shields to undertake the work remotely under pressure and without inflow or loss of soil. There is also a further advantage in that they can be used as access tunnels from where it is possible to undertake, for example, a program of drilling and injection to stabilize the soil in the area where the arched support structure is to be installed.

Figure 5:
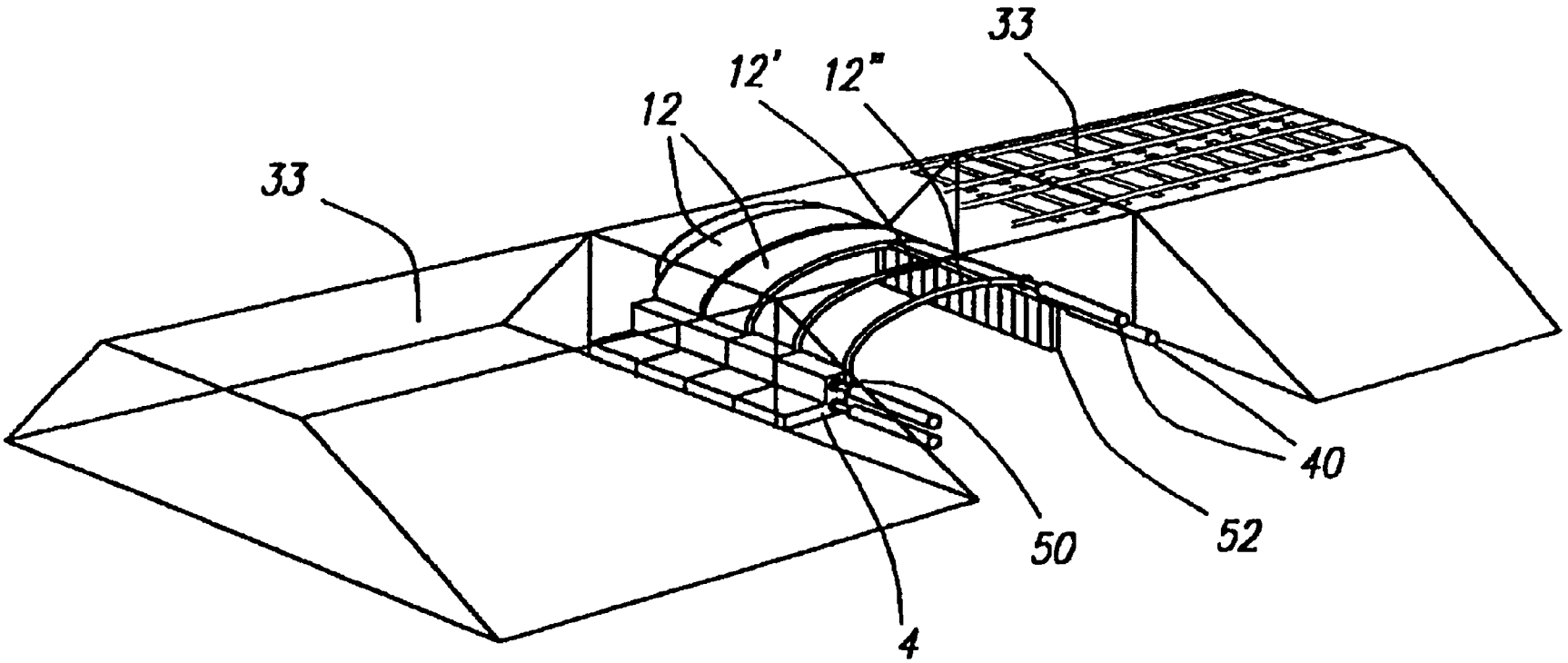
FIG. 5 illustrates a perspective view of a support structure formed according to FIG. 4 on the right hand side of the tunnel and an alternative method on the left hand side for the purpose of illustration.

FIG. 5 illustrates on the on the right hand side of the tunnel a support structure formed using the tunnels 40 as shown in FIG. 4. Prior to installing the guide track along the tunnels, the tunnels remains enclosed and allows access to construct. This construction could be by methods such as diaphragm walling, contiguous piling to form a piling wall 52, for example.

On the left hand side of the tunnel an alternative arrangement is shown whereby the arch structure is formed by arch sections 50 which connect, with the tracks of the supporting units 4, acting as side wall panels and it is the end of the side wall which locates with the foundations. In this embodiment therefore the support structure is formed of arch sections, side wall supporting units and foundation units, introduced in the same manner as previously described.

The operation according to the invention comprises excavating, jacking and adding new arch sections until the structure is in its final position and excavation is completed.

Furthermore, as the arch sections are moved into place it is possible to structurally link all the sections to provide additional strength such as by using Macalloy HT (Registered Trade Mark) bars placed in ducts provided in the concrete sections and stressed.

It should be noted that any of the embodiments shown can be used to advantage in conditions and requirements to which one, or a combination of the embodiments, is or are suited.

Thus it will be appreciated that there is provided a method for forming a structure in an excavation without the need to disturb the surface above the excavation and also provides for the utilisation of the relevant strength of arch shaped sections. Furthermore, the provision of the tracks, and use of supporting units which can be set to the required line and level before the jacking of the sections, ensures that once set, the line and level no longer needs to be checked and the arched sections can be relatively easily jacked into position along the tracks.

While the invention has been described with a certain degree of particularly, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element.

What is claimed is:

1. A tunnel support structure to support excavated areas beneath the surface of the earth during excavation, said support structure comprising:

a series of supporting units; and a series of upstanding arch-shaped sections positioned one after another along a length of the excavated area and being located along said series of supporting units and wherein each said arch-shaped section is pushed or jacked in an upstanding positioned into the excavated area as the excavated area is formed;

wherein each of said supporting units has recessed sections forming a track when laid end-to-end along which the arch-shaped sections slide, the recessed sections including removable covers to prevent the ingress of soil until the recessed sections are exposed to allow the arch-shaped sections to slide therealong.

2. A tunnel support structure according to claim 1 wherein said supporting units form at least two linear tracks spaced apart by a distance determined by the space between the ends of said arch-shaped sections.

3. A tunnel support structure according to claim 1 wherein said arch-shaped sections and said supporting units are pre-cast.

4. A tunnel support structure according to claim 1 wherein each of said arch-shaped sections is formed from a series of panels which are constructed on site.

5. A tunnel support structure according to claim 1 wherein said structure has a leading face.

6. A tunnel support structure according to claim 5 wherein a temporary shield is fitted at said leading face of said support structure allowing excavation work to be undertaken.

7. A tunnel support structure according to claim 1 wherein said support units are formed by shields which are filled with concrete, thereby forming tracks therein.

8. A tunnel support structure according claim 1 wherein a plurality of side-by-side support structures are created by the use of at least three sets of in-line supporting units, said support units configured so as to comprise two lines of outer supporting units and a center line of at least a single unit having two guide tracks formed therein, thus allowing introduction of two sets of side-by-side arch-shaped sections along said supporting units.

9. A tunnel support structure according to claim 1 wherein said arch-shaped sections are load bearing.

10. A method for forming a tunnel support structure for an excavated area beneath the surface during excavation of the same, said method comprising the steps of:

as a tunnel is excavated, pushing or jacking a series of arch sections in an upstanding position one after another into said excavated area to form an arched support structure;

wherein said arch sections are introduced along a series of supporting units in at least two spaced sets, wherein each of said supporting units has a recessed portion forming a track, the recessed portions including removable covers to prevent the ingress of soil until the recessed sections are exposed to allow the arch sections to slide therealong.

11. A method according to claim 10 wherein said supporting units are first position in the excavation to act as guides along which said arch sections are introduced.

12. A method according to claim 10 wherein said supporting units act as side wall portions which extend upwardly to form side walls of said arch support structure and the arched sections are introduced to act as roof panels and form said arched support structure.

13. A method according to claim 12 wherein the ends of said panels are located in tracks formed by a series of said supporting units which may be jacked into the tunnel including the step of jacking said supporting units into the tunnel to provide tracks of a sufficient length to receive the arched sections to form said arch support structure.

14. A method according to claim 12 wherein hydrophilic gaskets or groutable injection hoses are introduced between said panels as they are installed in a working area thereby waterproofing the joints between said panels.

15. A method according to claim 10 in which bottom tracks for said arch sections are formed in the supporting units.

16. A method according to claim 10 wherein said supporting units are a series of blocks.

17. A method according to claim 10 wherein said supporting units are provided by forming tunnels.

18. A method according to claim 17 wherein in each tunnel there is formed a track for the reception of the ends of the arch sections which again pass along the length of the tracks as with the supporting units and therefore act to support the arch sections.

19. A method according to claim 17 wherein the tunnels may be used for access.

20. A method according to claim 10 wherein said arch sections comprise roof and side walls when jacked into the excavation.

21. A method according to claim 10 wherein said excavated area is a tunnel and further includes the steps of:

jacking a series of arch sections into said excavation at intervals and introducing new sections from an open end of said tunnel to increase the length of said support structure as the tunnel is excavated.

22. A method according to claim 10 wherein said tunnel excavation takes place to the front of the first of said arch sections introduced.

23. A method according to claim 10 wherein said arch sections are load bearing.

24. A method for forming a tunnel support structure for an excavated area beneath the surface of the earth during excavation of the same, said method comprising the steps of:

driving supporting units into a tunnel excavation;

manipulating said supporting units to form a guide;

leveling said supporting units;

inserting into said supporting units a series of arched-shaped sections in an upstanding position one after another;

attaching a temporary cutting shield onto the end of the front of said series of arched-shaped sections;

excavating said area;

advancing said shield and jacking said arched-shaped sections until reaching a pre-determined distance; and removing said shield after reaching said pre-determined distance.

25. A method according to claim 24 wherein said arched-shaped sections are load bearing.

* * * * *